US007159492B2

(12) United States Patent
Macor

(10) Patent No.: US 7,159,492 B2
(45) Date of Patent: Jan. 9, 2007

(54) WRENCH ENGAGEMENT STRUCTURE

(75) Inventor: Richard J. Macor, Hunterdon County, NJ (US)

(73) Assignee: Proprietary Technologies, Inc., Asbury, NJ (US)

( * ) Notice: Subject to any disclaimer, the term of this patent is extended or adjusted under 35 U.S.C. 154(b) by 0 days.

(21) Appl. No.: 11/372,784

(22) Filed: Mar. 10, 2006

(65) Prior Publication Data

US 2006/0174731 A1 Aug. 10, 2006

Related U.S. Application Data

(63) Continuation-in-part of application No. 11/050,949, filed on Feb. 4, 2005, now abandoned.

(51) Int. Cl.
*B25B 13/06* (2006.01)

(52) U.S. Cl. ..... 81/121.1; 81/124.3

(58) Field of Classification Search ..... 81/119, 81/121.1, 124.3, 124.6; *B25B 13/06*
See application file for complete search history.

(56) References Cited

U.S. PATENT DOCUMENTS 3,354,757 A * 11/1967 Grimm et al. ..... 81/124.3
D465,707 S 11/2002 Chen
2005/0034570 A1* 2/2005 Hsien ..... 81/124.6

* cited by examiner

*Primary Examiner*—Hadi Shakeri

(57) ABSTRACT

A wrench tool is described comprising an orifice which has a predetermined geometry for controlling the rotation of a hexagonal work piece. The orifice is substantially cylindrical and comprises an array of only eighteen longitudinal grooves positioned therein. The grooves form a symmetrical pattern around an imaginary central axis. The grooves are formed and spaced apart so as to create an array of only eighteen longitudinal protuberances. The protuberances form a symmetrical pattern around the imaginary central axis for engagement with the work piece. In one embodiment, the protuberances are positioned apart relative to each other and to the imaginary central axis by predetermined dimensions.

6 Claims, 2 Drawing Sheets

WRENCH ENGAGEMENT STRUCTURE

REFERENCES TO RELATED APPLICATIONS

This application relates to, and is a continuation-in-part of U.S. Pat. application Ser. No. 11/050,949 filed on Feb. 4, 2005 now abandoned entitled Wrench engagement technologies, also filed by the inventor herein.

FIELD OF THE INVENTION

The present invention relates to hand tools, particularly hand operated wrenches, and more particularly box type wrenches and wrench sockets.

BACKGROUND OF THE INVENTION

Hand operated wrenches have been around for many years and most are designed to control the rotation of hexagonal fasteners. Box type wrenches and/or wrench sockets each generally have a six or twelve point socket opening for turning fasteners such as nuts and bolts and the like. It is believed by some that the six point design can apply more torque to a fastener then the twelve point design without "rounding" the fastener. On the other hand, the twelve point design is desirable because it requires less re-engagement swing arc than the six point design. The language of "re-engagement swing arc" shall be defined herein as the least amount of swing arc required (measured in degrees) for a wrench to re-engage a work piece such as a fastener that is being tightened or loosened. The minimum re-engagement swing arc of a twelve point wrench design is thirty degrees, or half of the minimum re-engagement swing arc of a six point design which is sixty degrees. Applicant contemplates an improved wrench that will require less re-engagement swing arc than each of the prior art, six and twelve point wrench designs, while maintaining reasonable, if not substantial wrench strength to maximize the application of torque to a work piece such as a fastener, while minimizing fastener deformation and wrench breakage.

SUMMARY OF THE INVENTION

A wrench tool is described comprising an orifice which has a predetermined geometry for controlling the rotation of a hexagonal work piece. The orifice is substantially cylindrical and comprises an array of only eighteen longitudinal grooves positioned therein. The grooves form a symmetrical pattern around an imaginary central axis. The grooves are formed and spaced apart so as to create an array of only eighteen longitudinal protuberances. The protuberances form a symmetrical pattern around the imaginary central axis for engagement with the work piece. In one embodiment, the protuberances are positioned apart relative to each other and to the imaginary central axis by predetermined dimensions.

With regards to the present invention above, applicant considers the following objectives:

It is an important objective of the present invention that it requires less re-engagement swing arc than each of the prior art, six and twelve point wrench designs.

It is another important objective of the present invention that it provide a user with better accessibility to fasteners than each of the prior art, six and twelve point wrench designs, especially in limited access environments.

It is another important objective of the present invention that it provide better synchronization and initial engagement with a work piece such as a fastener, than each of the prior art, six and twelve point wrench designs.

It is another important objective of the present invention that it achieves reasonable, if not substantial wrench strength to maximize the application of torque to a work piece such as a fastener, while minimizing fastener deformation and wrench breakage.

And, it is yet another important objective of the present invention that it be cost efficient to manufacture and commercially viable.

DETAILED DESCRIPTION OF THE DRAWINGS

The various drawings provided herein are for the purpose of illustrating possible embodiments of the present invention and not for the purpose of limiting same. Therefore, the drawings herein represent only a few of the many possible variations of the present invention.

Figure 1:
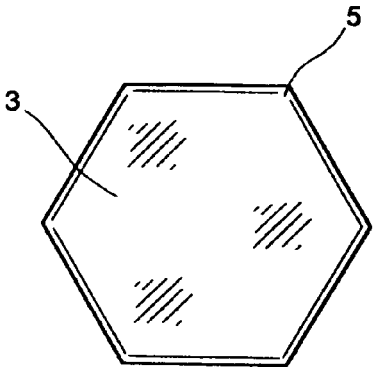
FIG. 1 shows a top plan view of a hexagonal work piece such as a bolt head; and, FIG. 2 shows a top plan cut view of a box type wrench having a wrench head comprising an embodiment of the present invention wrench engagement technologies; and, FIG. 3 shows an enlarged fragmentary view of the wrench head shown in FIG. 2, and, FIG. 4 shows a top plan view of a wrench socket comprising another embodiment of the present invention wrench engagement technologies.

FIG. 1 shows a top plan view of a hexagonal work piece such as a bolt head. Hexagonal work piece 3 has six points represented by point 5. The present invention wrench engagement technologies are generally designed to function best with hexagonal fasteners such as nuts, bolts, hexagonal screws etc.

Figure 2:
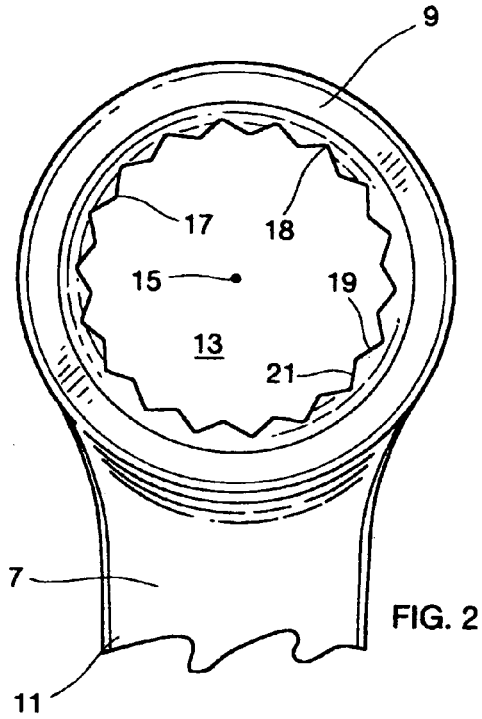
Figure 3:
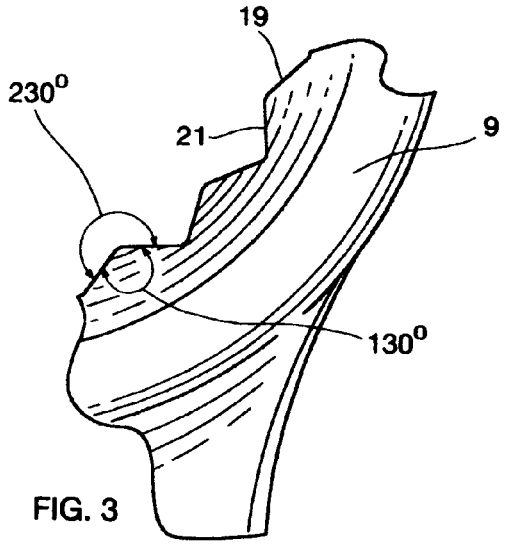

Referring now to FIGS. 2 and 3 together, FIG. 2 shows a top plan cut view of a wrench having a wrench head comprising an embodiment of the present invention wrench engagement technologies; and, FIG. 3 shows an enlarged fragmentary view of the wrench head shown in FIG. 2. In FIG. 2 wrench 7 is shown having a wrench head 9 and wrench handle 11. Wrench head 9 comprises an orifice 13 which has a predetermined geometry for controlling the rotation of a hexagonal work piece such as a nut, bolt or other hexagonal fastener etc. The orifice 13 is substantially cylindrical and comprises an array of eighteen longitudinal grooves positioned therein substantially forming a symmetrical pattern around an imaginary central axis 15. Groove 18 is one of the eighteen grooves and is representative of such. The eighteen grooves are formed and spaced apart so as to create an array of eighteen longitudinal protuberances. Protuberance 17 is one of the eighteen protuberances and representative of such. The present invention is designed to function best with only eighteen longitudinal grooves and only eighteen longitudinal protuberances. The protuberances form a symmetrical pattern around the imaginary central axis 15 for engagement with a work piece, such as hexagonal work piece 3 shown in FIG. 1. Each of the eighteen protuberances is formed having at least two outer engaging surfaces such as engaging surfaces 19 and 21 shown which substantially form an outer engaging angle measured in degrees. In this embodiment of the present invention the outer engaging angle formed by each protuberance is preferably in the range of 223 through 237 degrees inclusive; and, more preferably in the range of 226 through 234 degrees inclusive; and, most preferably in the range of 229 through 231 degrees, such as 230 degrees as shown. The engaging surfaces of this embodiment of the present invention may be substantially flat, substantially arcuate, concave, convex, multi-faceted, and/or any combination thereof. Nonetheless, each protuberance is preferably formed having at least two outer engaging surfaces which substantially form an outer engaging angle in the range of 223 through 237 degrees inclusive, to achieve off-corner loading and force distribution between wrench and work piece. Off-corner loading and force distribution will maximize the application of torque to a work piece while minimizing deformation of the work piece and wrench breakage. In the event that the engaging surfaces are curved or arcuate, the engaging surfaces are simply positioned tangent to the aforementioned preferred outer engaging angles.

Figure 4:
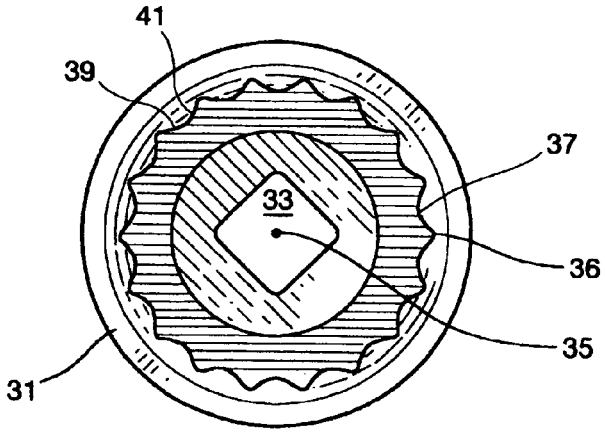

FIG. 4 shows a top plan view of a wrench socket comprising another embodiment of the present invention wrench engagement technologies. Wrench socket 31 is shown comprising an orifice 33 which has a predetermined geometry for controlling the rotation of a hexagonal work piece such as a nut, bolt or other hexagonal fastener etc. The orifice 33 is substantially cylindrical and comprises an array of eighteen longitudinal grooves positioned therein forming a symmetrical pattern around an imaginary central axis 35. Groove 36 is one of the eighteen grooves and is representative of such. The eighteen grooves are formed and spaced apart so as to create an array of eighteen longitudinal protuberances. Protuberance 37 is one of the eighteen protuberances and is representative of such. The present invention is designed to function best with only eighteen longitudinal grooves and only eighteen longitudinal protuberances. The protuberances form a symmetrical pattern around the imaginary central axis 35 for engagement with a work piece, such as hexagonal work piece 3 shown in FIG. 1. Each of the eighteen protuberances has at least two outer engaging surfaces represented by engaging surfaces 39 and 41 which are substantially arcuate convex. The engaging surfaces could also be substantially flat, concave, multi-faceted, and/or any combination thereof. In this embodiment of the present invention each protuberance has at least two outer engaging surfaces tangent to an outer engaging angle preferably in the range of 223 through 237 degrees inclusive; and, more preferably in the range of 226 through 234 degrees inclusive; and, most preferably in the range of 229 through 231 degrees such as 230 degrees.

Figure 5:
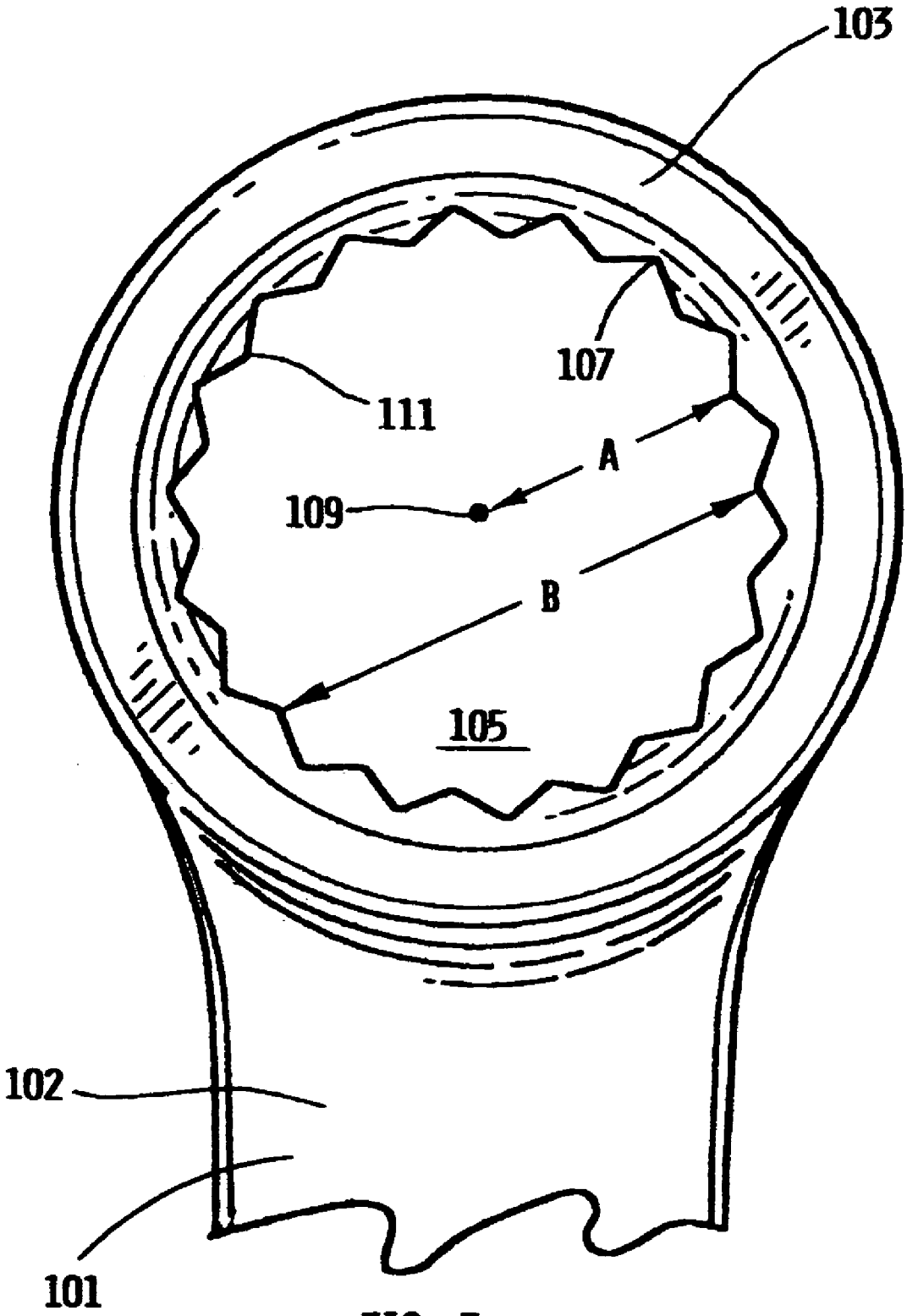
FIG. 5 shows a top plan cut view of a box type wrench having a wrench head comprising another embodiment of the present invention wrench engagement technologies.

FIG. 5 shows a top plan cut view of a box type wrench 101 comprising another embodiment of the present invention wrench engagement technologies. Wrench 101 comprises a handle 102 and wrench head 103 which comprises an orifice 105 which has a predetermined geometry for controlling the rotation of a hexagonal work piece. Orifice 105 is substantially cylindrical and comprises an array of eighteen longitudinal grooves therein with groove 107 representative of such grooves. The eighteen grooves substantially form a symmetrical pattern around an imaginary central axis 109. The eighteen grooves are formed and spaced apart so as to create an array of only eighteen longitudinal protuberances with protuberance 111 representative of such protuberances. The protuberances also substantially form a symmetrical pattern around imaginary central axis 109 for engagement with a work piece such as work piece 3 shown in FIG. 1. The protuberances are positioned apart relative to each other and to the imaginary central axis 109 by predetermined dimensions whereas the least distance (or shortest measurable dimension) between imaginary central axis 109 and each of the protuberances is a predetermined Dimension A as shown, and, the least distance (or shortest measurable dimension) between any eight adjacent protuberances is a predetermined Dimension B as shown. In this embodiment of the present invention, Dimension A is preferably equal to or greater than 52% of Dimension B and equal to or less than 55% of Dimension B; and more preferably, Dimension A is equal to or greater than 52.5% of Dimension B and equal to or less than 54.5% of Dimension B; and most preferably, Dimension A is equal to or greater than 53% of Dimension B and equal to or less than 54% of Dimension B. This predetermined geometry and dimensional relationship provides optimum off-corner loading and force distribution between wrench and work piece, while maintaining the proper amount of free play between wrench and work piece.

Each of the novel "eighteen point" design configurations of the present invention described above require significantly less re-engagement swing arc than each of the prior art, six and twelve point wrench designs. Again, the language of "re-engagement swing arc" shall be defined herein as the least amount of swing arc required (measured in degrees) for a wrench to re-engage a work piece such as a fastener that is being tightened or loosened. The minimum re-engagement swing arc of the present invention is just 20 degrees, while the prior art six and twelve point designs require 60 degrees and 30 degrees respectively. Accordingly, the next best prior art wrench design (12 points) requires an additional 50% more re-engagement swing arc than the present invention. And, the prior art six point design requires an additional 200% more re-engagement swing arc than the present invention. Therefore, the present invention described above provides superior accessibility to fasteners, especially in limited access environments. Another benefit of the present invention described above is that it requires less time and effort to synchronize the wrench orifice onto a work piece during the initial engagement process, because synchronization requires less rotation of the wrench head than either the aforementioned prior art wrench designs.

It is believed that the present invention wrench engagement technologies will have many applications to different wrenches, including but not limited to box wrenches, doublebox wrenches, combination wrenches and wrench sockets of all lengths. When considering the present invention, simplicity and obviousness should not be confused or considered the same. Accordingly, the novelty and complexity of the present invention must be measured by its structure resulting from the many interrelated objectives set forth herein, including wrench to fastener accessibility in normal and limited access environments, wrench to fastener synchronization (initial engagement), wrench strength, wrench torque capacity, deformation of the work piece, manufacturability, and commercial viability.

Although illustrative embodiments have been described herein in detail, it should be noted and will be appreciated by those skilled in the art that numerous variations may be made within the scope of this invention without departing from the principles and chief advantages of this invention. Unless otherwise specifically stated, the terms and expressions have been used herein as terms of description and not limitation. There is no intention to use the terms or expressions to exclude any equivalents of features shown and described or portions thereof, and this invention should be defined in accordance with the claims that follow, or the equivalence thereof.

Having thus described the invention, the following is claimed:

1. A wrench tool comprising an orifice having a predetermined geometry for controlling the rotation of a hexagonal work piece, said orifice being substantially cylindrical and comprising an array of only eighteen longitudinal grooves positioned therein substantially forming a symmetrical pattern around an imaginary central axis, said eighteen grooves being formed and spaced apart so as to create an array of only eighteen longitudinal protuberances, said protuberances substantially forming a symmetrical pattern around said imaginary central axis for engagement with said work piece, each said protuberance further being formed having at least two outer engaging surfaces substantially forming an outer engaging angle within the range of 223 through 237 degrees inclusive and, said protuberances being positioned apart relative to each other and to said imaginary central axis by predetermined dimensions whereas the least distance between said imaginary central axis and each said protuberance being a predetermined Dimension A, and the least distance between any eight adjacent protuberances being a predetermined Dimension B, and, Dimension A being substantially equal to or greater than 52% of Dimension B and substantially equal to or less than 55% of Dimension B.

2. A wrench tool of claim 1, wherein Dimension A is substantially equal to or greater than 52.5% of Dimension B and substantially equal to or less than 54.5% of Dimension B.

3. A wrench tool of claim 1, wherein said wrench tool is a wrench socket.

4. A wrench tool of claim 1, wherein said wrench tool comprises a box type wrench head.

5. A wrench tool of claim 1 wherein said engaging surfaces are substantially flat.

6. A wrench tool of claim 1, wherein said engaging surfaces are substantially arcuate and tangent to said outer engaging angle within the range of 223 through 237 degrees inclusive.

* * * * *